US005671503A

United States Patent [19]

Uebelacker et al.

[11] Patent Number: 5,671,503

[45] Date of Patent: Sep. 30, 1997

[54] ATTACHABLE STORAGE HANDLE FOR BEVERAGE CONTAINER

[76] Inventors: Peggy Uebelacker; John Caravella, both of 27844 Quail View La., Wesley Chapel, Fla. 33544-3400

[21] Appl. No.: 709,280

[22] Filed: Sep. 6, 1996

[51] Int. Cl.[6] ..... A47B 95/02

[52] U.S. Cl. ..... 16/110.5; 16/114 R; 220/737; 220/756

[58] Field of Search ..... 16/110.5, 111 R, 16/114 R; 215/390, 395, 396; 220/737, 756, 23.2, 23.4, 23.86

[56] References Cited

U.S. PATENT DOCUMENTS 4,230,235 10/1980 Di Amico ..... 220/94
5,292,039 3/1994 Neofitou ..... 222/424
5,325,982 7/1994 Cobb, Jr. ..... 220/212
5,385,277 1/1995 Drew et al. ..... 222/474
5,484,081 1/1996 Jahn ..... 220/759

*Primary Examiner*—Chuck Y. Mah

[57] ABSTRACT

An attachable storage handle for a beverage container comprising a detachable storage container (40) and an attaching member (50) having a hole (52). In one embodiment, the attaching member (50) is an inverted L-shaped member. The long portion (54) of the L-shaped member (50) is permanently attached to the exterior surface (22) of a beverage container (20) with adhesive (30). The storage container (40) is detachably engaged within the hole (52) of the short portion (56). The storage container (40) has a resealable closure means (60) for selectively opening and closing coupled to the top end (44) of the storage container (40, [as all the above are so referenced to FIG. 7]).

1 Claim, 3 Drawing Sheets

10
20
22
24
26
30
40
42
44
46
48
49
50
52
54
56
58
59
60

ATTACHABLE STORAGE HANDLE FOR BEVERAGE CONTAINER

BACKGROUND OF THE INVENTION

1. Field of the Invention

This invention related generally to beverage containers and specifically to a removable storage handle from an attaching member which is permanently affixed to a beverage container with adhesive.

2. Description of the Background Art

Presently, most commercially available portable beverage containers are well known throughout the industry. Typically, a beverage container comprises a bottle with a cap assembly. The cap assembly usually has an opening for a straw wherein the straw has a tethered tip to prevent leakage. Also, beverage containers including integrally formed handles are known in the industry.

These beverage containers are popular with sports enthusiasts because they provide a means to carry liquid refreshment during a workout or while away from a reliable source of water. These beverage containers are filled with refreshments before the workout and are then consumed during the course of the workout. However, these refreshments are often depleted before the conclusion of the workout; thus, requiring the beverage container to be replenished with water from the nearest source. Often the beverage container is replenished with water from a public fountain or a water fountain in a gym. Although these sources provide water, often an alternative flavor is desired. Thus, powdered drink mixes are desired to provide an alternative to water.

What is needed then is a storage handle that provides a means for storing the powder to be mixed with water to create a flavored drink. This storage handle must also prevent the stored powder from being exposed to moisture such as the condensation resulting from cold liquid being held in the beverage container. As previously mentioned a variety of beverage containers exist, but none provide a means for separately storing powders that will also keep the powder dry.

Furthermore, U.S. Pat. No. 5,484,081 of Jahn teaches a handle for a beverage container wherein a hand graspable handle portion is releasably attached to a beverage container by suction cups. The apparatus of Jahn includes a handle including a pair of spaced end portions having an intermediate hand graspable portion disposed therebetween. However, this handle shows no capacity for storage nor, with its attachment at both ends, would this handle allow the beverage container to hang on sports equipment or other devices for easy access by its user.

U.S. Pat. No. 5,385,277 issued to Drew et al. teaches a carbonated beverage bottle handle, pour and storage device comprising a bottle top, flapper, handle and actuator portions. The handle portion is fixed to the bottle top portion and is gripped for holding a bottle. The actuator portion is squeezable towards the handle portion to allow liquid to be poured. While the device of Drew et al. comprises a separate handle which may be affixed to a beverage container, Drew's device is designed to be releasably attached and does not provide a storage means within the handle.

U.S. Pat. No. 5,292,039 to Neofitou teaches a bottle for storing a liquid and dispensing measured quantities thereof. Specifically, the bottle has a large storage chamber and a small measuring chamber, each chamber including its own threaded, removable cap. In a preferred embodiment, a conduit between these two chambers forms a handle with the remainder of the bottle, thus serving as a handle.

The patent to Neofitou provides a good discussion of prior art hand-held squeeze bottles for dispensing measured quantities of liquid. These patents (Reyman, Donoghue and Griffiths) are drawn to measuring and dispensing bottles having two liquid storage chambers, futher comprising complex valve mechanisms and conduits to prevent drainage into the storage compartment. The device of Neofitou is structurally complex, involves the interaction of two liquids and, while the handle of the device serves as a conduit, it is not applicable to service as a separate storage compartment, particularly for storage of powders.

U.S. Pat. No. 5,325,982 to Cobb, Jr. teaches a single integral cap and handle assembly adapted to be screwed on the narrow threaded open neck of a container. The handle has aligned openings for removably engaging and holding a straw. The device of Cobb, Jr. is designed to be a combination cap and handle for the common sports type bottle. While the handle is designed to hold a straw, the device does not teach a handle suitable for storage of powdered beverages, snack foods or small personal items such as jewelry, money and keys.

U.S. Pat. No. 4,230,235 to DiAmico teaches a beverage can having a foldable handle. The device of DiAmico provides a handle means permanently secured to the beverage can exterior surface which has a first position flush against the exterior surface of the can and a second position where the handle is folded over upon itself such that it outwardly projects from the beverage container thereby converting into a handle. The device of DiAmico is designed to be for single use, the handle is not suitable nor is it designed to store small personal items or powered beverages, nor is it unattached on its bottom to allow for hanging on bicycles, tread mills or such other devices.

OBJECTS AND ADVANTAGES

In response to the realized inadequacies of these earlier devices, it became clear that there is a need for a removable storage handle capable of hanging a beverage container and keeping stored powders or small personal items free of moisture. In as much as the art consists of various types of beverage dispensers, it can be appreciated that there is a continuing need for and interest in improvements to beverage dispensers, and in this respect, the present invention addresses these needs and interests.

Therefore, the principal object of this invention is to provide an improvement which overcomes the aforementioned inadequacies of the prior art devices and provides an improvement which is a significant contribution to the advancement of the portable beverage dispenser art.

Another object of this invention is to provide a new and improved attachable handle which has all the advantages and none of the disadvantages of the earlier mentioned art.

Still another objective of the present invention is to provide a storage compartment that keeps small items, including powdered beverages, disposed within the storage container free of moisture.

Yet another objective of the present invention is to provide a hand graspable handle to allow a beverage container to be handled easily.

Still a further objective of the present invention is to provide a durable storage handle for sports enthusiasts.

Yet a further objective is to provide a beverage container and storage compartment that is lightweight and which may be easily transported from one location to another.

An additional objective is to provide an open ended storage handle that is easily manufactured and assembled.

Another objective is to provide a beverage container having a storage compartment that does not interfere with the users activities.

A further objective is to provide a handle that allows for convenient hanging of the beverage container at or near its users location.

Even yet another objective is to provide a handle assembly adapted to being adhered to an exterior surface of a beverage container body.

The foregoing has outlined some of the pertinent objects of the invention. These should be construed to be merely illustrative of some of the more prominent features and applications of the intended invention. Many other beneficial results can be obtained by applying the disclosed invention in a different manner or by modifying the invention within the scope of the disclosure. Accordingly, other objects and a more comprehensive understanding of the invention may be obtained by referring to the summary of the invention, and the detailed description of the preferred embodiment in addition to the scope of the invention defined by the claims taken in conjunction with the accompanying drawings.

SUMMARY OF THE INVENTION

The present invention generally relates to a detachable storage handle for beverage containers. For the purpose of summarizing the invention, the invention comprises a handle assembly comprising an attaching member having a hole wherein the storage container top end of a storage container is detachably engaged within the hole. The attaching member with storage container provides a hand graspable handle for a beverage container. The attaching member is adhered to a beverage container with adhesive disposed between the attaching member and the exterior surface of a beverage container. A resealable closure means for selectively opening and closing the opening in the storage container is coupled to the storage container top end. The attaching member is substantially L-shaped inverted having a short portion and a long portion wherein the hole is through the short portion. The opening of the storage container is at the storage container top end which receives the resealable closure means. It is preferred that the closure means is either a pressure fitted cap or an internally threaded cap matingly engaged to the storage container top end. An important feature of the present invention is that the storage container is unaffected by moisture from the beverage container and acts as a handle that may be detached from the remainder of the beverage container. Therefore, it can be readily seen that the present invention provides a means to carry and protect additional items from moisture. Thus, a portable beverage container having a detachable storage container would be greatly appreciated.

The foregoing has outlined rather broadly, the more pertinent and important features of the present invention. The detailed description of the invention that follows is offered so that the present contribution to the art can be more fully appreciated. Additional features of the invention will be described hereinafter. These form the subject of the claims of the invention.

BRIEF DESCRIPTION OF THE DRAWINGS

For a more succinct understanding of the nature and objects of the present invention, reference should be directed to the following detailed description taken in connection with the accompanying drawings in which.

Similar reference characters refer to similar parts throughout the several views of the drawings.

Reference Numerals in Drawings

20 BEVERAGE CONTAINER BODY
22 EXTERIOR SURFACE OF BEVERAGE CONTAINER BODY
24 BEVERAGE CONTAINER TOP END
26 BEVERAGE CONTAINER BOTTOM END
30 ADHESIVE
40 STORAGE CONTAINER BODY
41 OPENING TO STORAGE CONTAINER TOP END
42 OUTER SURFACE OF STORAGE CONTAINER BODY
44 STORAGE CONTAINER TOP END
45 EXTERNAL THREADING OF STORAGE CONTAINER TOP END
46 STORAGE CONTAINER BOTTOM END
48 COLLAR
49 SPLINE
50 ATTACHING MEMBER
52 HOLE
54 LONG PORTION OF ATTACHING MEMBER
56 SHORT PORTION OF ATTACHING MEMBER
58 INNER CIRCUMFERENTIAL SURFACE OF HOLE
59 GROOVE
60 RESEALABLE CLOSURE MEANS
62 REMOVABLE PRESSURE FITTED CAP
64 REMOVABLE THREADED CAP

DETAILED DESCRIPTION OF THE PREFERRED EMBODIMENT

Figure 1:
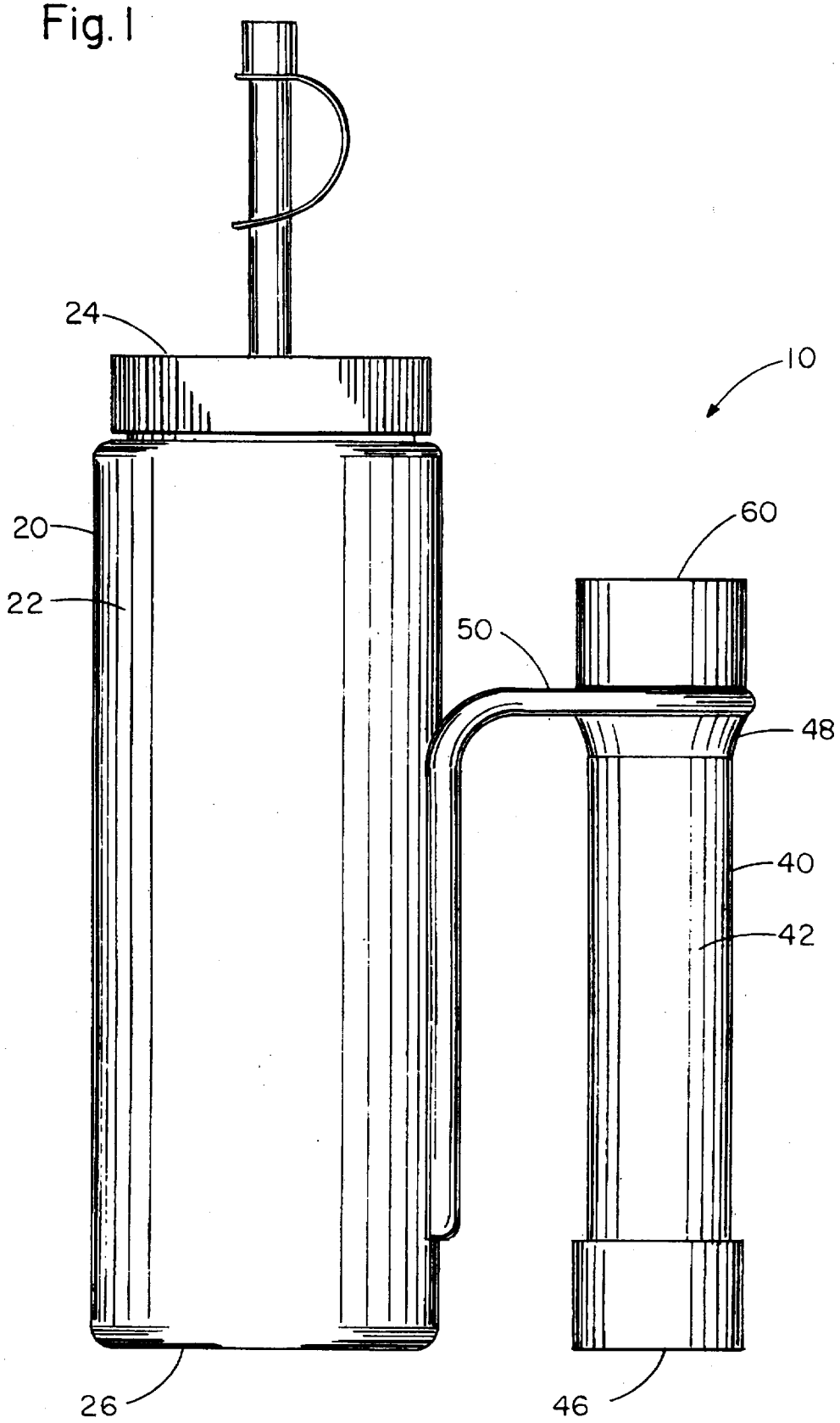
FIG. 1 is a side view of the present invention.

With reference to the drawings, and in particular to FIG. 1 thereof, an attachable storage handle for beverage container embodying the principles and concepts of the present invention and generally designated by the reference number 10 will be described.

Figures 2, 3, 4:
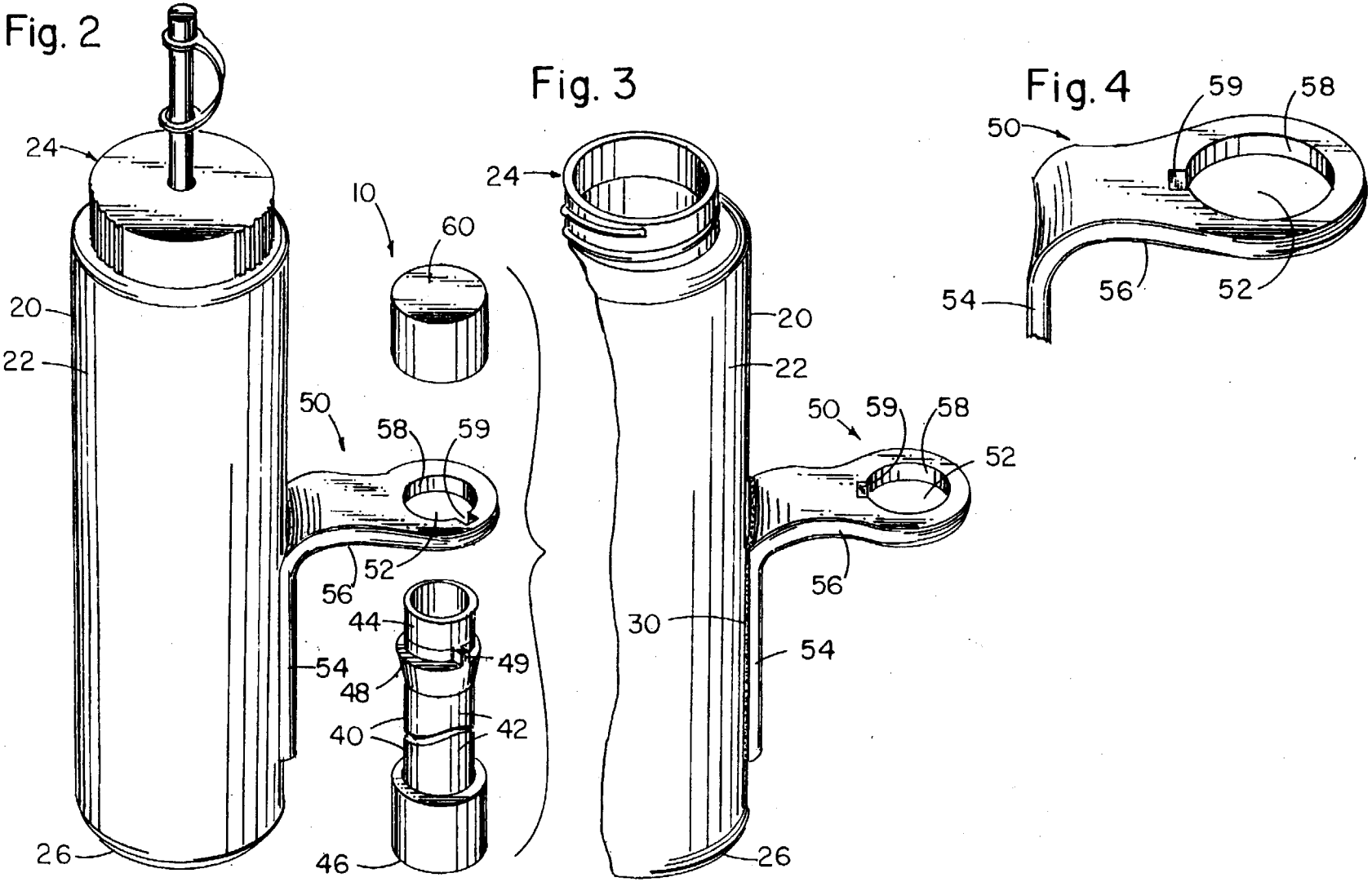
FIG. 2 is a perspective side view of the present invention illustrating an open storage container removed from the attaching member.
FIG. 3 is a perspective side view of the attaching member of the present invention particularly illustrating the adhesive adhering the long portion of the L-shaped attaching member to the exterior surface of the beverage container.
FIG. 4 is a perspective top view of the L-shaped attaching member of the present invention illustrating the groove and inner circumferential surface of the hole.

As shown in FIG. 2, the attachable storage handle 10 comprises a beverage container body 20 having an exterior surface 22, a storage container body 40 having an outer surface 42, resealable closure means 60, and an attaching member 50 including a hole 52. The attachable storage handle 10 of the present invention further comprises an adhesive 30 as shown in FIG. 3.

Other than the adhesive 30, the attachable storage handle 10 and the attaching member 50 may be formed of different materials but, from a manufacturing perspective, are preferably formed of the same material. The present invention is preferably injection molded from a durable plastic material which has received U.S. Food and Drug Administration approval for use in connection with food. The preferred plastic material is polypropylene but other polyolefins may be used, such as a high density polyethylene copolymer. One advantage of using plastic material is that the attachable storage handle 10 will not rust. However, any suitable material may be used including metal or the like.

As seen in FIG. 2, the beverage container body 20 of the present invention has a beverage container top end 24 and an opposite beverage container bottom end 26. The storage container body 40 is laterally spaced from the beverage container body 20 such that moisture or condensation from the beverage container body 20 will not affect the contents of the storage container body 40. The attaching member 50 is interposed between the beverage container body 20 and the storage container body 40. The storage container body 40 is detachably coupled within the hole 52 of the attaching member 50. An advantage associated with the present invention is that the storage container body 40 provides a hand graspable and hangable handle for the beverage container body 20.

As seen in FIG. 3, the adhesive 30 of the present invention is disposed upon the attaching member 50. The adhesive 30 upon the attaching member 50 is configured to allow the attaching member 50 to be permanently affixed to the exterior surface 22 of the beverage container body 20.

As seen in FIG. 2, the storage container body 40 is detachably engaged within the hole 52 of the attaching member 50; and, as shown in FIG. 3, the adhesive 30 permanently adheres the attaching member 50 to the exterior surface 22 of the beverage container body 20.

As seen in FIG. 3, in the preferred embodiment of the present invention, the attaching member 50 is substantially an inverted L-shape including a long portion 54 and a short portion 56. Moreover, it is preferred that the attaching member 50 is rigid. The hole 52 is through the short portion 56 and is sized to receive the storage container top end 44 (FIG.2) of the storage container body 40 (FIG.2). The short portion 56 protrudes radially outward from the exterior surface 22 of the beverage container body 20. The long portion 54 is adapted for fitting flush against the exterior surface 22 of the beverage container body 20. The adhesive 30 then adheres the long portion 54 to the exterior surface 22 of the beverage container 20.

Figure 5:
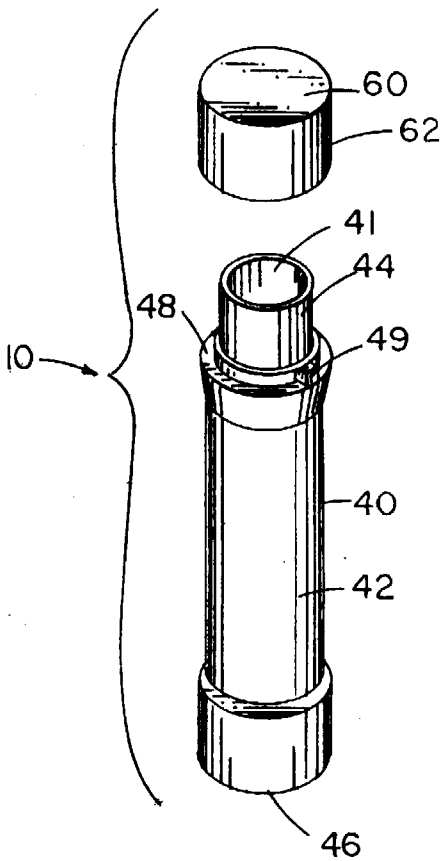
FIG. 5 is a perspective side view of the storage container of the present invention illustrating one embodiment of the collar and spline as well as the removable cap capable of being pressure fitted to the storage container top end.

As shown in FIG. 4, the hole 52 includes an inner circumferential surface 58 along with a groove 59 within the inner circumferential surface 58. As seen in FIG. 5, the storage container 40 of the present invention has a storage container top end 44 with an opening 41 and an opposite storage container bottom end 46. The outer surface 42 of the storage container body 40 can have a collar 48, that at least partially surrounds the outer surface 42 of the storage container body 40, and a spline 49. It is preferred that the collar 48 completely surround the outer surface 42 of the storage container body 40 as shown in FIGS. 5 and 6.

As shown in FIGS. 4 and 5, the advantage of the collar 48 and the spline 49 is that when the storage container top end 44 is engaged within the hole 52 of the attaching member 50, the collar 48 seats up against the attaching member 50 so that the storage container body 40 may not pass completely through the hole 52. The spline 49, on the other hand, engages the groove 59 of the attaching member 50 and prevents the storage container body 40 from rotating within the hole 52. The advantage of the storage container body 40 is that it allows for storage of items as well as acts as a hand graspable handle for the beverage container body 20 when inserted in the hole 52 of the attaching member 50.

Figure 6:
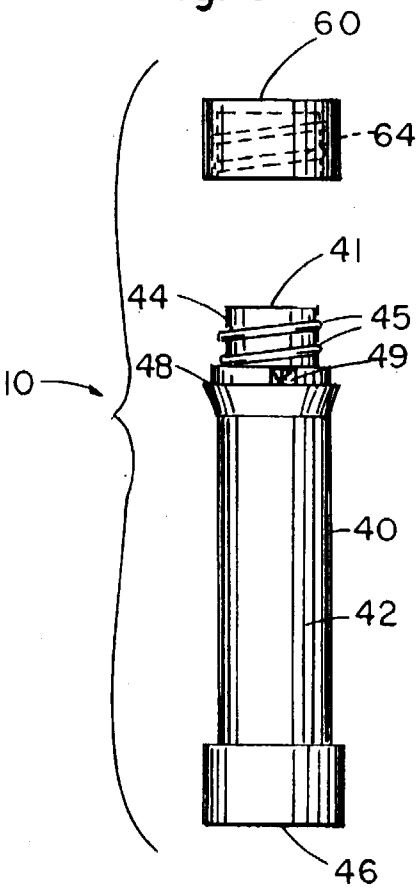
FIG. 6 is a side view of the storage container of the present invention illustrating an alternative embodiment of the collar and spline as well as an internally threaded cap capable of being fitted to the storage container top end.

FIG. 5 and 6 illustrate the preferred embodiments for the resealable closure means 60 for selectively opening and closing the opening 41 matingly engaged to the storage container top end 44. FIG. 5 illustrates a resealable closure means 60 comprising a removable cap 62 that is pressure fitted to the storage container top end 44. Alternatively, FIG. 6 illustrates a resealable closure means 60 comprising an internally threaded cap 64 threadably engaging the storage container top end 44 wherein the storage container top end 44 includes external threads 45.

After extensive investigation and experimentation, the present inventors have discovered that the adhesive 30 of the present invention is the preferred means of permanently securing the attaching member 50 to the beverage container body 20. It is particularly preferable that an adhesive 30 be used as 9473 by 3M or the like. Many other brands of adhesive 30 including TESSA 4965, 3M 9500PC and 3M 443 were found to have poor performance characteristics for their intended use in the present invention. The present inventors have also discovered that it is preferable that the adhesive 30 be double sided. However, there should not be a paper or similar lining, acting as a carrier, within the adhesive 30 because the linings or backings typically disintegrates due to the extreme conditions the user would expose the present invention to. However, 3M 9473PC was found to have exceptional characteristics under the most extreme conditions involving temperature and strength.

FIG. 1 illustrates an alternative embodiment of the present invention wherein both the beverage container body 20 and the storage container body 40 are positioned such that the plane of the storage container bottom end 46 and the beverage container bottom end 26 are the same. The advantage associated with this embodiment, is that the beverage container body 20 will not easily tip over when the beverage container body 20 is near empty as it would when the storage container bottom end 46 is not long enough to contact the ground.

As shown in FIGS. 2 and 3, the short portion 56 is positioned nearer the edge of the beverage container top end 24, thereby protruding radially outward from the exterior surface 22 of the beverage container body 20. The advantage with this configuration is that the beverage container body 20 then has the capability of being hung over a pair of handle bars or similar structure that may be positioned in between the two container bodies 20 and 40. The closer the short portion 56 of the attaching member 50 is to the beverage container top end 24, the more vertical the beverage container body 20 would be when full when straddling a pair of handle bars or similar structure because of its center of gravity.

Figure 7:
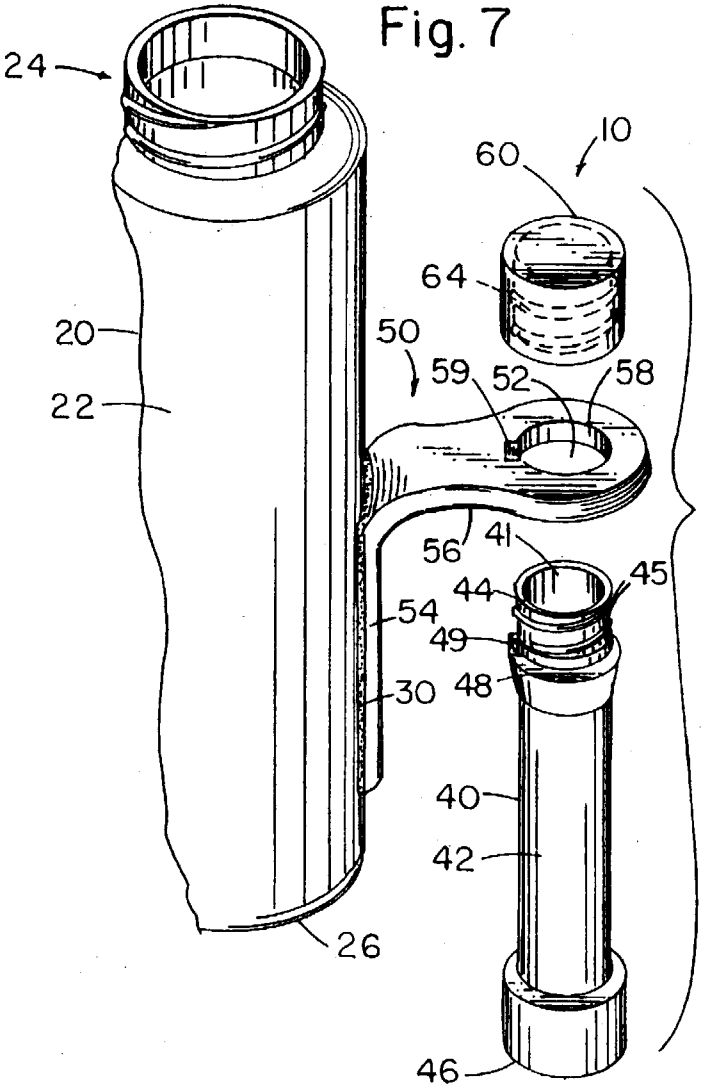
FIG. 7 is a perspective side view of the attaching member adhered to the exterior surface of the beverage container body with adhesive, plus the storage container and removable cap removed from the attaching member.

FIG. 7 portrays a complete showing of all members described above.

The previously described embodiments of the present invention have many advantages, including the storage of powdered beverage mixes, the storage of assorted small personal items, a more convenient manner to carry a large beverage container and the ability to hang a beverage container in close proximity to its place of use.

While the above description contains many specificities, these should not be construed as limitations on the scope of the invention, but rather as an examplification of one preferred embodiment. Many other variations are possible. For example; the attaching member may be attached to the beverage container body in differing manners such as strapping, glue products, or other manners of fusion that may show the attaching member as being an integral part of the beverage container body; the storage container body and removable cap may take an outer circumferential form other than round and be of varied overall size yet still perform the same designed functions; the removable cap may also incorporate other methods of closure, such as a snap fit, yet still facilitate its intent to provide a resealable closure means; for the purpose of providing only an attachable handle, the above assembly may be fabricated in a single and solid configuration without departing from the spirit and scope of the invention. Accordingly, the scope of the invention should be determined not by embodiments illustrated, but by the appended claims and their legal equivalents.

Now that the invention has been described, what is claimed is:

1. A removable storage handle for a beverage container comprising: an attaching member, a storage container body and a resealable closure means;

said attaching member is substantially configured having a vertical portion and a horizontal portion;

said vertical portion configured to be attached to an exterior surface of a beverage container body and to conform substantially flush with said beverage container body;

said horizontal portion protruding radially outward from said vertical portion and containing a hole vertically therethrough;

said hole comprising an inner circumferential surface with said inner circumferential surface containing a groove;

said storage container body is substantially tube shaped with an open top end and a closed bottom end;

said top end having an outer surface comprising a collar and a spline;

said collar at least partially surrounding said outer surface of storage container body and seating up against said attaching member and said spline engaging said groove of said hole when said storage container body is engaged within said hole;

said resealable closure means matingly engages said top end thereby creating an interlocking synergistic union between said attaching member, said storage container body and said resealable closure means.

* * * * *